US005882173A

United States Patent [19]

Ziegler

[11] Patent Number: 5,882,173

[45] Date of Patent: Mar. 16, 1999

[54] GOLF BALL STACKING AND DISPENSING APPARATUS AND METHOD

[76] Inventor: Charles B. Ziegler, 1687 NE. Northview, Bend, Oreg. 97701

[21] Appl. No.: 939,770

[22] Filed: Sep. 29, 1997

[51] Int. Cl.[6] ..... B65B 35/50; A47F 7/00

[52] U.S. Cl. ..... 414/788; 414/787; 414/801; 206/315.9; 206/499; 211/14; 473/131; 473/409

[58] Field of Search ..... 414/788, 788.9, 414/799, 922, 801; 211/14, 15, 59.4, 123, 206; 206/315.9, 499, 564; 473/131, 409

[56] References Cited

U.S. PATENT DOCUMENTS

| | | | |
|---|---|---|---|
| 1,201,441 | 10/1916 | Clinger . | |
| 2,384,794 | 9/1945 | Buckley et al. | 211/15 |
| 3,147,980 | 9/1964 | Gollahon . | |
| 3,302,843 | 2/1967 | Sheehan | 206/315.9 |
| 3,325,000 | 6/1967 | Edwards | 206/564 |
| 4,286,715 | 9/1981 | Martelli et al. | 206/564 |
| 4,602,789 | 7/1986 | Chung . | |
| 5,381,895 | 1/1995 | Thomsen . | |
| 5,394,986 | 3/1995 | Oya et al. | 206/564 |
| 5,467,574 | 11/1995 | Thomsen . | |
| 5,551,832 | 9/1996 | Kelly . | |
| 5,720,397 | 2/1998 | Thompson | 211/59.4 |
| 5,746,332 | 5/1998 | Kleinschmidt | 211/14 |

*Primary Examiner*—Karen M. Young
*Assistant Examiner*—Douglas Hess
*Attorney, Agent, or Firm*—David S. Alavi

[57] ABSTRACT

A golf ball stacking and dispensing apparatus is disclosed herein comprising: a) a substantially rectangular base frame; b) a plurality of rails substantially parallel to one pair of opposing sides of the rectangular base frame and secured at each end to the other pair of opposing faces of the rectangular base frame; and c) a hopper having an open-bottomed pyramidal lower section. The top edges of the sides of the base frame may extend above the tops of the rails. The rails are substantially uniformly spaced apart, with spacing and transverse dimensions such that a golf ball may not pass between adjacent rails, but rather is constrained to lie on each of two adjacent rails and roll along their lengths in a groove formed therebetween. The spacing between centerlines of adjacent rails must be larger than a ball diameter and less than about 1.414 times the ball diameter. Balls may be stacked on the apparatus by placing the hopper on the base frame, pouring balls into the hopper until a base layer is filled and a pyramidal stack is formed, and removing the hopper. Golf balls may be dispensed from the stack by rolling balls from the stack or along the grooves and over the side of the base frame into a practice area.

19 Claims, 6 Drawing Sheets

GOLF BALL STACKING AND DISPENSING APPARATUS AND METHOD

FIELD OF THE INVENTION

The field of the present invention relates to golf ball stacking apparatus and methods. In particular, apparatus and methods are described herein for stacking golf balls in a pyramidal stack and dispensing the golf balls from the stack for use.

BACKGROUND

At a golf practice area, it is desirable to provide a golfer with a large supply of golf balls for use during a practice session. Such a supply of golf balls may be provided as a basket of balls carried by the golfer to the practice area. The golf balls must typically be removed by hand from the basket and moved to the practice area, which is time consuming and cumbersome for the golfer, requiring him/her to repeatedly bend over to remove golf balls from the basket. Alternatively, the entire basket of balls may be emptied into the practice area, resulting in a cluttered practice area, a falling/tripping hazard for the golfer, and significant numbers of balls rolling out of the immediate practice area which must be retrieved by the golfer or collected by golf facility personnel. The large number of balls required for a protracted practice session may also be too heavy (100 golf balls weigh about 10 pounds) to be readily carried to the practice area, necessitating repeated trips obtain more balls for continued practice.

Other previous means for providing a supply of golf balls for a practice session have employed a pyramidal stack of golf balls. Square pyramidal stacks of golf balls are provided by methods and apparatus disclosed in U.S. Pat. Nos.: 5,551,832 to Kelly; U.S. Pat. No. 5,467,574 to Thomsen; and U.S. Pat. No. 5,381,895 to Thomsen. Such pyramidal stacks offer the advantage over baskets of ease of dispensing golf balls for use. One or more golf balls may be knocked off of the stack by the head (i.e., lower end) of a golf club wielded by the golfer, without the need for the golfer to bend over to remove the balls by hand. Pyramidal stacks may also be considered an attractive way of presenting a supply of golf balls for use. Stacking the balls in a pyramid, however, may be quite labor intensive unless some means is used to quickly and readily create the stack. The Kelly patent discloses an open-bottomed square pyramidal shell which may be inverted and golf balls to be stacked poured in. When the pyramidal shell is filled, a square tray is placed over the open bottom and the entire assembly of shell, tray, and balls is turned upright. The tray holds the square pyramidal stack of golf balls after removal of the pyramidal shell. A drawback of this system is the fact that the stack (in the shell) must be held while the shell is being filled, and the assembly of shell, balls, and tray must be turned upright manually. This necessarily limits the weight (and therefore size) of a golf ball stack that may be practically achieved by this stacking system. The limit is typically 91 golf balls (a six layer stack, 6×6 balls on the bottom layer, 9.7 pounds) or 140 golf balls (a seven layer stack, 7×7 balls on the bottom layer, 14.9 pounds). A larger stack of balls, allowing a more protracted practice session and requiring less frequent restacking by golf facility personnel, is desirable. In particular, it is desirable to produce a stack with sufficiently many balls to sustain a two hour practice session at a typical rate of three balls used per minute (at least 360 balls, weighing 38.2 pounds).

The Thomsen patents disclose a golf ball tray having a square array of spherical depressions for receiving golf balls.

A hopper with an open, square pyramidal lower end is placed over the tray, and golf balls are poured into a top opening of the hopper. As golf balls fill the spherical depressions, the square base layer, or array, of the pyramidal stack is formed. As more balls are poured in, subsequent layers are formed until the pyramidal stack is complete. Larger stacks of golf balls may be produced in this way, and the Thomsen patents disclose stacks as large as 204 golf balls (an eight layer stack, 8×8 balls on the bottom layer). It has been noted subsequently, however, that achieving complete filling of the base layer without excessive user manipulation and/or intervention is problematic. It is therefore desirable to provide apparatus and methods for producing a pyramidal stack of golf balls larger than previously disclosed which may be filled with little or no user manipulation and/or intervention, particularly when filling the base layer of the stack. The spherical depressions also make dispensing golf balls from the base layer with the head of a golf club difficult. It is therefore desirable to provide apparatus and methods for stacking golf balls in a pyramidal stack for use during golf practice sessions in which all of the golf balls in the stack, including the base layer, may be easily dispensed from the stack by a golfer using the head of a golf club.

SUMMARY

Certain aspects of the present invention may overcome one or more aforementioned drawbacks of the previous art and/or advance the state-of-the-art of golf ball stacking and dispensing apparatus and methods, and in addition may meet one or more of the following objects:

- To provide golf ball stacking and dispensing apparatus and methods which may produce a pyramidal stack of golf balls;
- To provide golf ball stacking and dispensing apparatus and methods which may produce a square pyramidal stack of at least 285 golf balls (nine layer stack, 9×9 balls on the bottom layer);
- To provide golf ball stacking and dispensing apparatus and methods which may produce a square pyramidal stack of 385 golf balls (ten layer stack, 10×10 balls on the bottom layer);
- To provide golf ball stacking and dispensing apparatus and methods wherein golf balls may be readily stacked with little or no manipulation and/or intervention;
- To provide golf ball stacking and dispensing apparatus and methods wherein a base layer of golf balls of the stack may be completely filled with little or no manipulation and/or intervention;
- To provide golf ball stacking and dispensing apparatus and methods which allow golf balls to be readily dispensed from the stack into a practice area with a golf club; and
- To provide golf ball stacking and dispensing apparatus and methods which allow golf balls to be readily dispensed from the base layer of golf balls with a golf club.

One or more of the foregoing objects may be achieved in the present invention by a golf ball stacking and dispensing apparatus comprising: a) a substantially rectangular base frame; b) a plurality of rails substantially parallel to one pair of opposing sides of the rectangular base frame and secured at each end to the other pair of opposing faces of the rectangular base frame; and c) a hopper having an open-bottomed pyramidal lower section. The top edges of the sides of the base frame may extend above the tops of the rails, in order to inhibit golf balls from rolling off the edges of the base frame, particularly during stacking. The rails are substantially uniformly spaced apart, with spacing and transverse dimensions such that a golf ball may not pass between adjacent rails, but rather is constrained to lie on each of two adjacent rails and roll along their lengths in a groove formed therebetween. The spacing between centerlines of adjacent rails must be larger than a ball diameter, so that balls in adjacent grooves may roll freely past one another, and less than about 1.414 times the ball diameter, so that the resulting base layer of balls thereby formed may support a pyramidal stack of balls thereon.

One or more of the foregoing objects may be achieved in the present invention by a golf ball stacking method comprising the steps of: a) placing the open-bottomed hopper over the rectangular base frame; b) pouring golf balls into the hopper until i) a full base layer of golf balls is produced on the rails of the base frame, and ii) a full pyramidal stack has been produced; and c) removing the hopper. One or more of the foregoing objects may be achieved in the present invention by a golf ball dispensing method comprising the steps of: a) placing, adjacent to a practice area, a golf ball stacking apparatus as described hereinabove with a pyramidal stack of golf balls thereon; b) orienting the stacking apparatus so that a golf ball rolled along a groove and over the edge of the base frame rolls into the practice area; and c) rolling balls from the stack into the practice area; and d) rolling balls from the base layer along a groove, over the side of the base frame, and into the practice area.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

For purposes of the present written description and/or claims, "practice area" shall denote any suitable area from which golf balls may be struck, whether the area is part of a golf facility or elsewhere. The words array and layer may be used interchangeably to denote a substantially horizontal two-dimensional arrangement of balls into substantially parallel, substantially uniformly spaced rows of balls, each row having the same number of balls. Rectangular and square shall have their usual geometric definitions, with a square being considered a special case of a rectangle. The terms rectangular or square may refer to either the measured size of a structure, or alternatively to the number of balls in a two-dimensional array of balls. A rectangular array of balls may therefore occupy a rectangular or square area, and likewise a square array of balls may occupy a rectangular or square area. The terms pyramid and pyramidal shall refer to a three-dimensional structure having a substantially horizontal polygonal base and an upwardly extending face corresponding to each side of the polygonal base. Each side of the polygonal base corresponds to the base of the corresponding upwardly extending pyramid face. Each face may be triangular with a top angle at the apex point of the pyramid. Alternatively, the faces may comprise a combination of triangles and trapezoids, with the apex of the pyramid comprising a line segment.

Figure 1B:
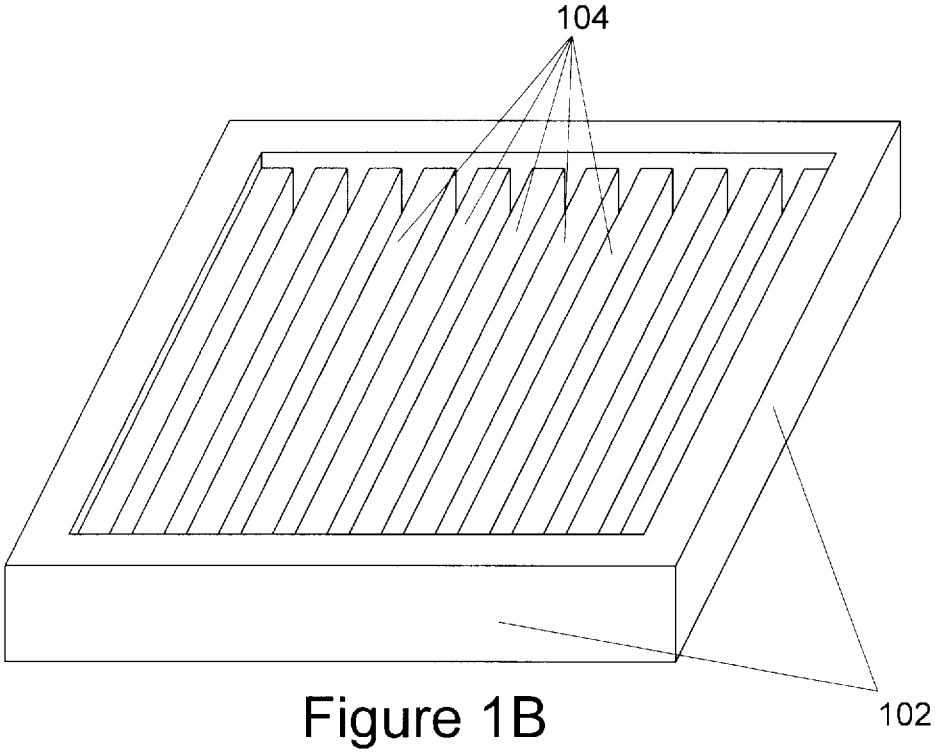
FIGS. 1A and 1B show top and perspective views, respectively, of a golf ball stacking apparatus according to the present invention.
Figure 1A:
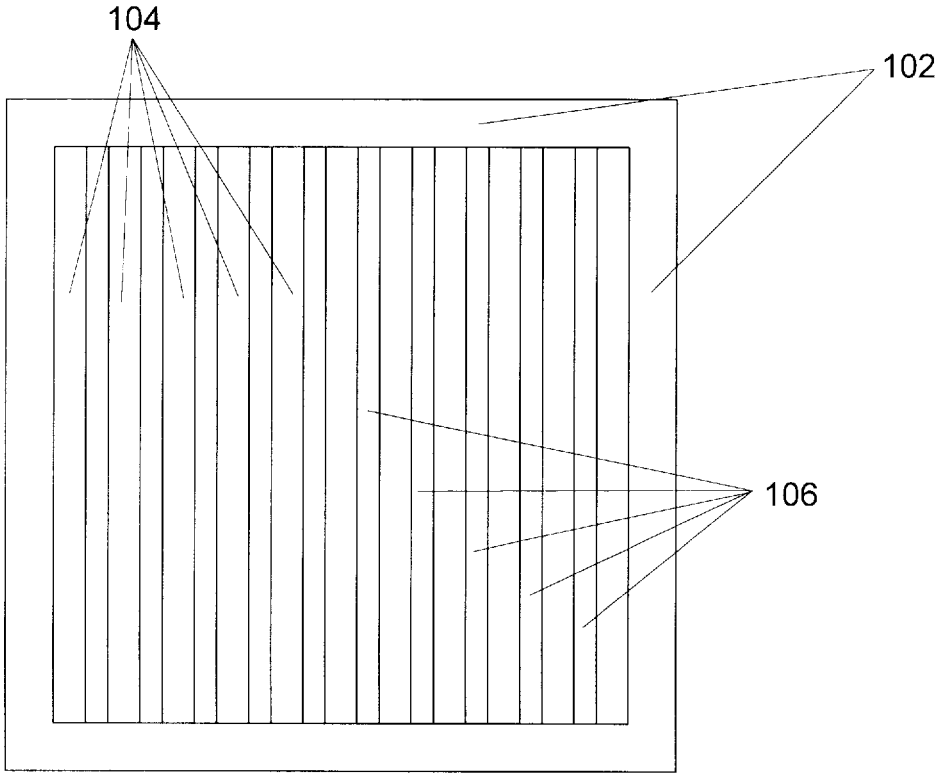

FIG. 1A and 1B show a top view of a golf ball stacking and dispensing apparatus according to the present invention. The stacking apparatus comprises a substantially square base frame 102 and substantially parallel rails 104 with grooves 106 therebetween. The base frame may preferably be about three inches deep. To accommodate a 10×10 square array of balls as a base layer for a pyramidal stack of golf balls, the substantially square area bounded by base frame 102 should be at least 16.8 inches by 16.8 inches, preferably about 17.8 inches by 17.8 inches. The rails: are secured at each end to opposing sides of the base frame (the first and last rails may also be secured along their respective lengths to an adjacent side of the base frame, or integral to the sides of the base frame); are positioned with a center-to-center distance of between about 1.68 inches and 2.38 inches, preferably about 1.78 inches; preferably have a substantially rectangular transverse cross section of about two inches high by about 1¼ inches wide (the first and last rails may be narrower); and are eleven in number to accommodate a 10×10 base layer of balls. The top edge of the base frame may preferably extend about ½ inch above the tops of the rails.

Figure 2B:
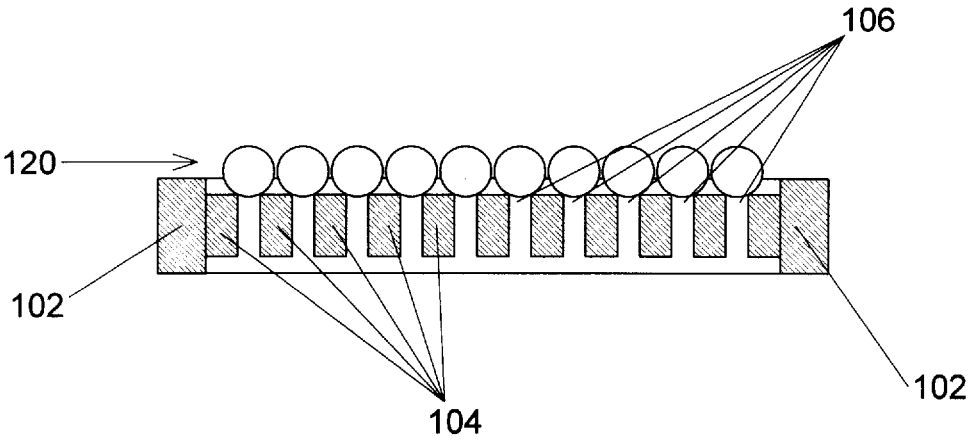
FIGS. 2A and 2B show top and section views, respectively, of a golf ball stacking apparatus according to the present invention with a base layer of golf balls thereon.
Figure 2A:
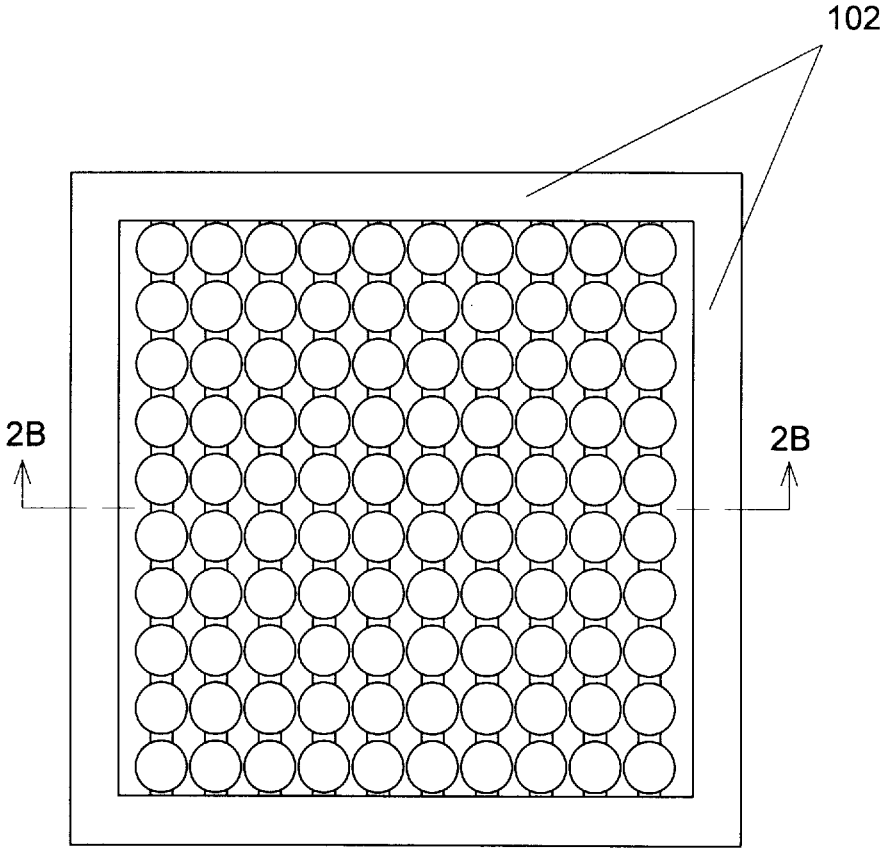

FIGS. 2A, 2B, 3A, 3B, 4A, and 4B show side sectional and top views of the stacking apparatus at various stages of filling. FIGS. 2A and 2B show the stacking apparatus with only a base layer 120 of golf balls thereon. The golf balls lie within grooves 106 formed by adjacent pairs of rails 104. The spacing and width of the rails prevent passage of golf balls between adjacent rails, and the spacing of the rails is such that balls in adjacent grooves may roll past one another. Movement of balls in the base layer is therefore only constrained in one dimension as balls are poured in and the stacking apparatus is filled, which facilitates complete filling of the base layer of the golf ball stack with little or no manipulation and/or intervention. Rolling of balls in the grooves also facilitates dispensing of balls from the base layer, particularly with a golf club. The balls may be rolled along a groove toward and over the edge of the base frame. The dispensing of balls is directional since the ball motion is constrained by the grooves; therefore proper orientation of the stacking apparatus with respect to the practice area facilitates dispensing of the balls to the proper location.

In contrast, the spherical depressions of the previous apparatus disclosed in the Thomsen patents, cited hereinabove, constrain the motion of the balls in two dimensions. This two-dimensional constraint has been found to hinder complete filling of the base layer of the pyramidal stack, necessitating manipulation and/or intervention while filling the stacking apparatus. The two-dimensional constraint also inhibits dispensing of balls from the base layer, particularly with a golf club, often necessitating bending over and removing balls from the base layer by hand. Even if a ball is removed from its spherical depression, once it is out it is no longer constrained in its subsequent motion. It may fall into another empty spherical depression, or may roll off of the previous stacking apparatus in any direction, not necessarily into the practice area.

Figure 3B:
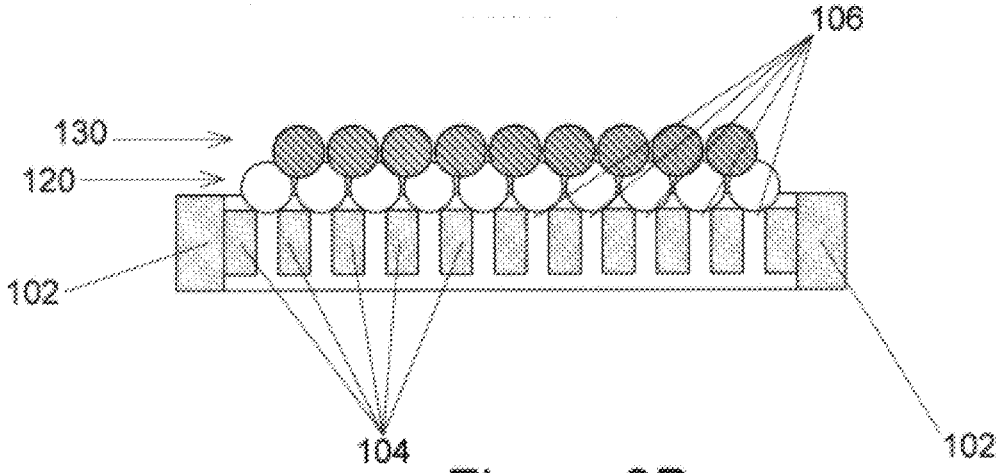
FIGS. 3A and 3B show top and section views, respectively, of a golf ball stacking apparatus according to the present invention with a base layer and a second layer of golf balls thereon.
Figure 3A:
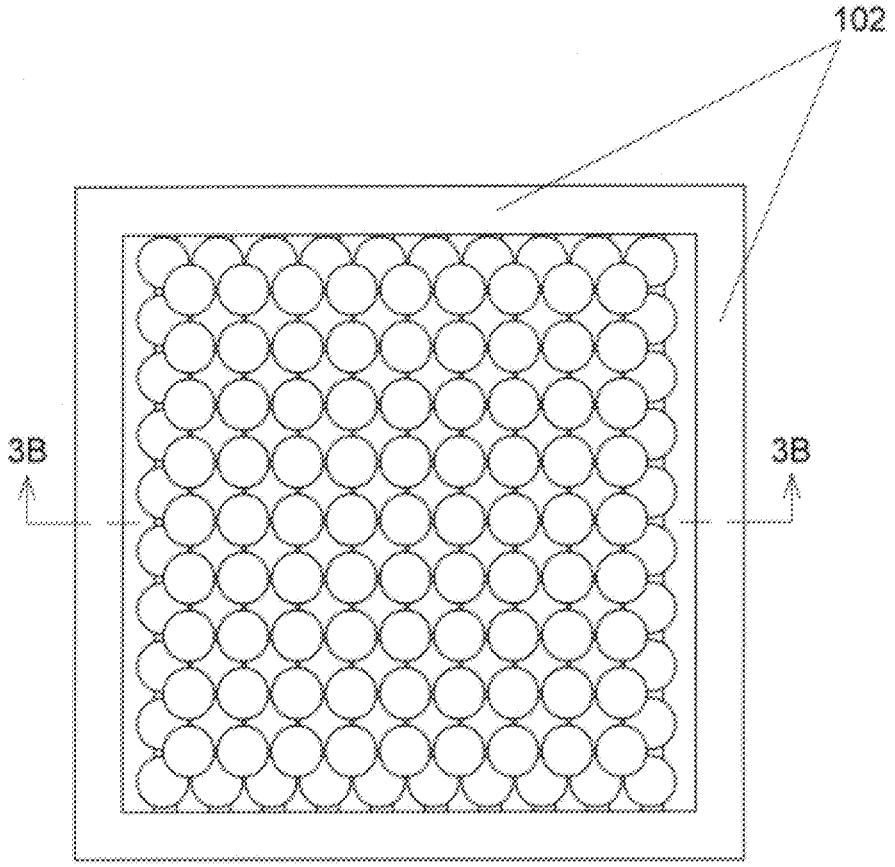
Figure 4B:
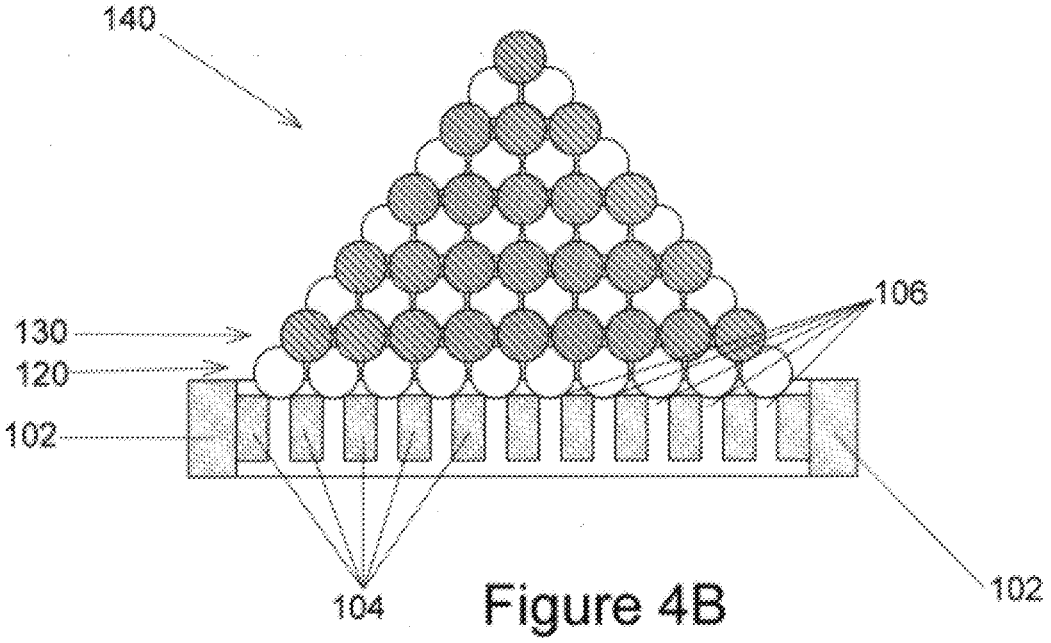
FIGS. 4A and 4B show top and section views, respectively, of a golf ball stacking apparatus according to the present invention with a pyramidal stack of golf balls thereon.
Figure 4A:
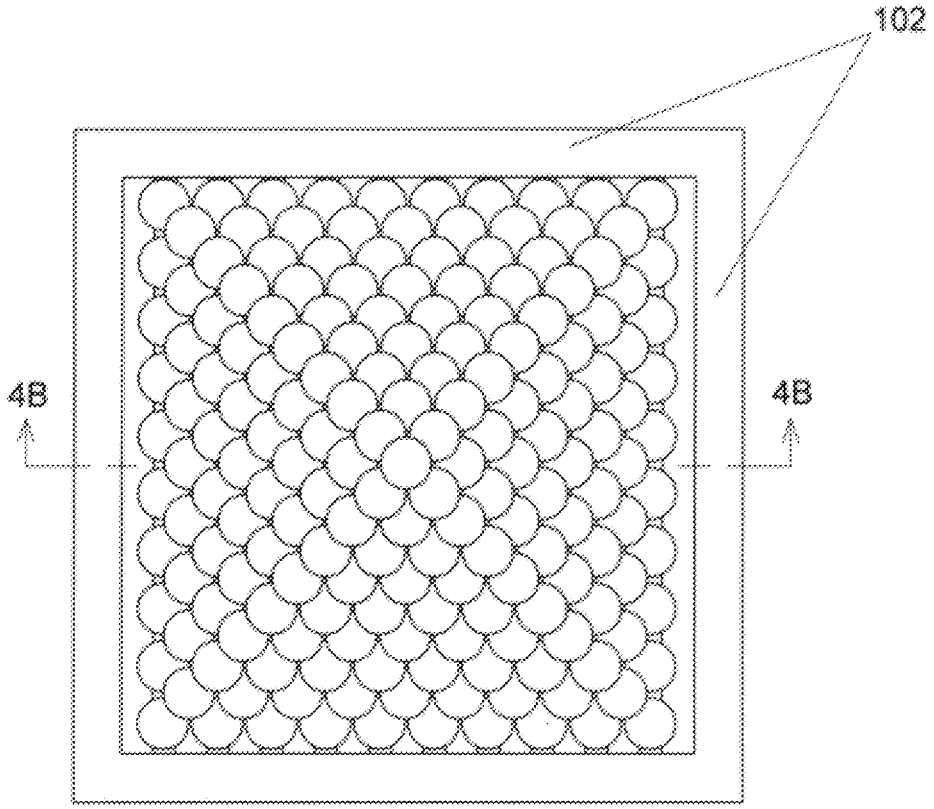
Figure 5:
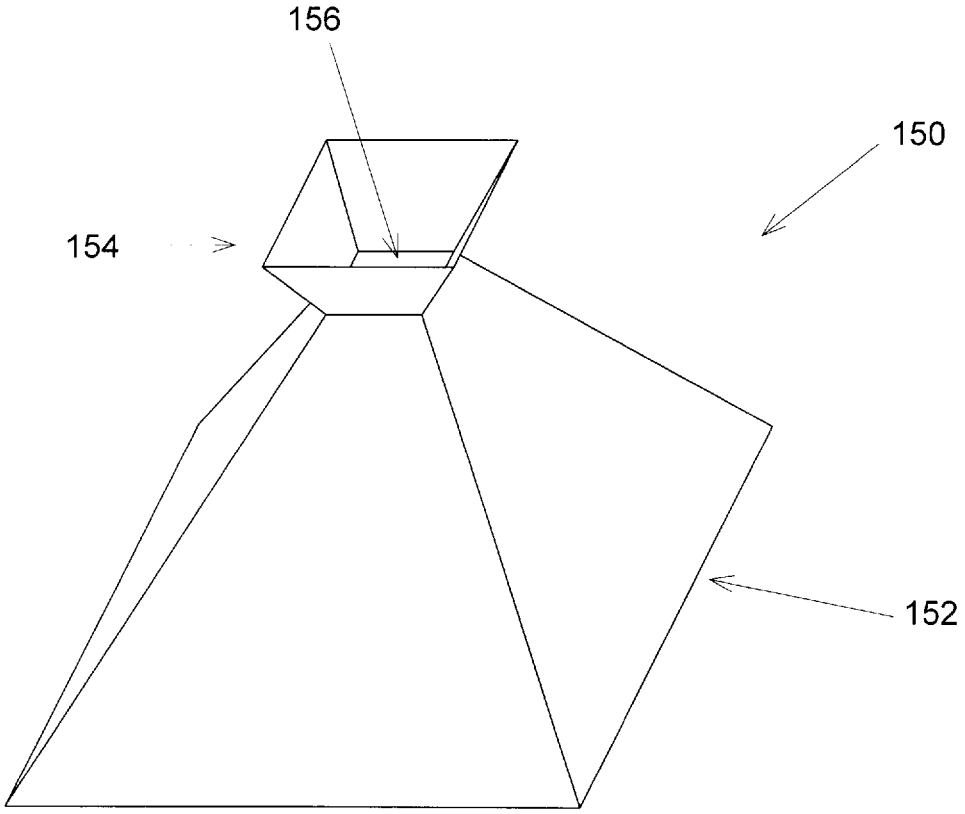
FIG. 5. is a perspective view of a hopper for stacking golf balls according to the present invention.

FIGS. 3A and 3B show the stacking apparatus with base layer 120 and second layer 130 of golf balls. The square array of base layer 120 gives rise to depressions between adjacent balls, which constrain and support the square array of balls forming second layer 130. Each ball in the second layer is supported by four balls of the base layer. This structure is repeated for each subsequent layer until a square pyramidal stack 140 is formed, as shown in FIGS. 4A and 4B A hopper 150 for filling the stacking apparatus is shown in FIG. 5. Lower portion 152 comprises a square pyramidal shell sufficiently large to enclose the pyramidal stack of golf balls supported by the base frame and rails. The dimensions of the base of lower portion 152 are preferably about 18 inches by 18 inches, and each of the four faces of lower portion 152 forms a tilt angle of between 46° and 57° with a horizontal plane, preferably between 50° and 53°. The square pyramidal shell is truncated to form an opening 156 in its top. Upper portion 154, comprising a downwardly tapered funnel-like structure, may be provided for opening 156, thereby facilitating pouring of golf balls in through opening 156.

A preferred method for stacking golf balls on the stacking apparatus comprises the steps of: a) placing the base of lower portion 152 of hopper 150 on frame 102; b) pouring golf balls through opening 156, until i) a full square base layer of golf balls is produced resting in grooves 106 between rails 104, and ii) a full square pyramidal stack has been produced; and c) removing hopper 150. Rolling of balls along grooves 106 facilitates filling of the base layer of balls with minimal manipulation and/or intervention. The faces of lower portion 152 of hopper 150 are large enough and tilted appropriately to accommodate the square pyramidal stack while forcing balls into proper positions in the stack and preventing balls from rolling down the side of the pyramidal stack.

A preferred method for dispensing golf balls from the stacking apparatus comprises the steps of: a) placing, adjacent to a practice area, a golf ball stacking apparatus as described hereinabove with a pyramidal stack of golf balls thereon; b) orienting the stacking apparatus so that a golf ball rolled along a groove and over the edge of the base frame rolls into the practice area; c) rolling balls from the stack into the practice area; and d) rolling balls from the base layer along a groove, over the side of the base frame, and into the practice area. The stacking apparatus is preferably positioned and oriented so that when balls are rolled off the stack, or along the grooves, they tend to roll into the desired golf practice area. The grooves and rails are therefore preferably oriented so that an imaginary line extending from and parallel to the rails would pass through the practice area.

Figure 6B:
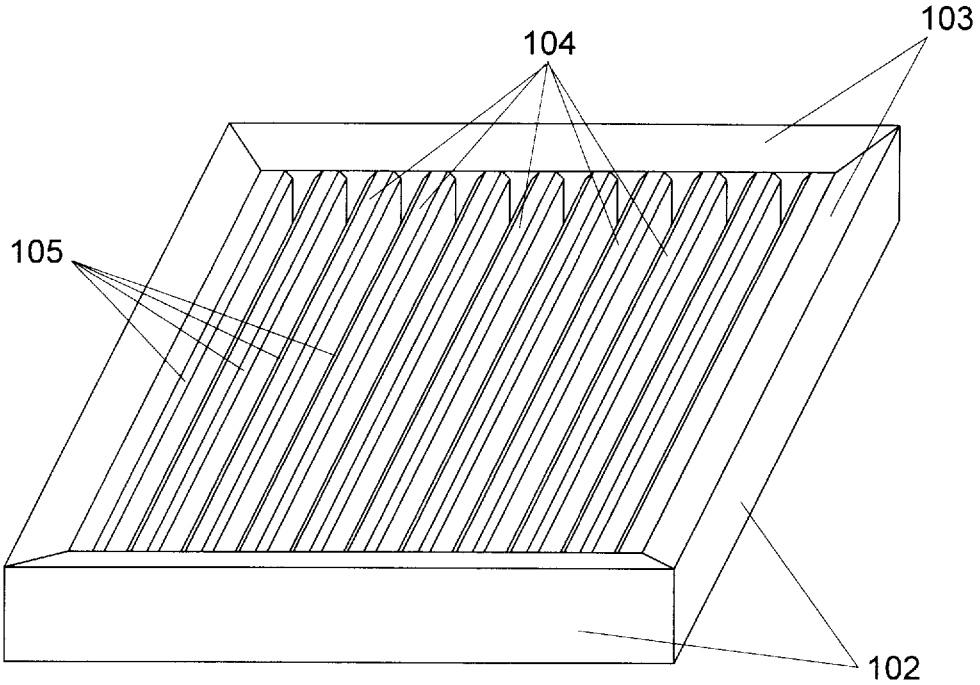
FIGS. 6A and 6B show top and perspective views, respectively, of a golf ball stacking apparatus according to the present invention.
Figure 6A:
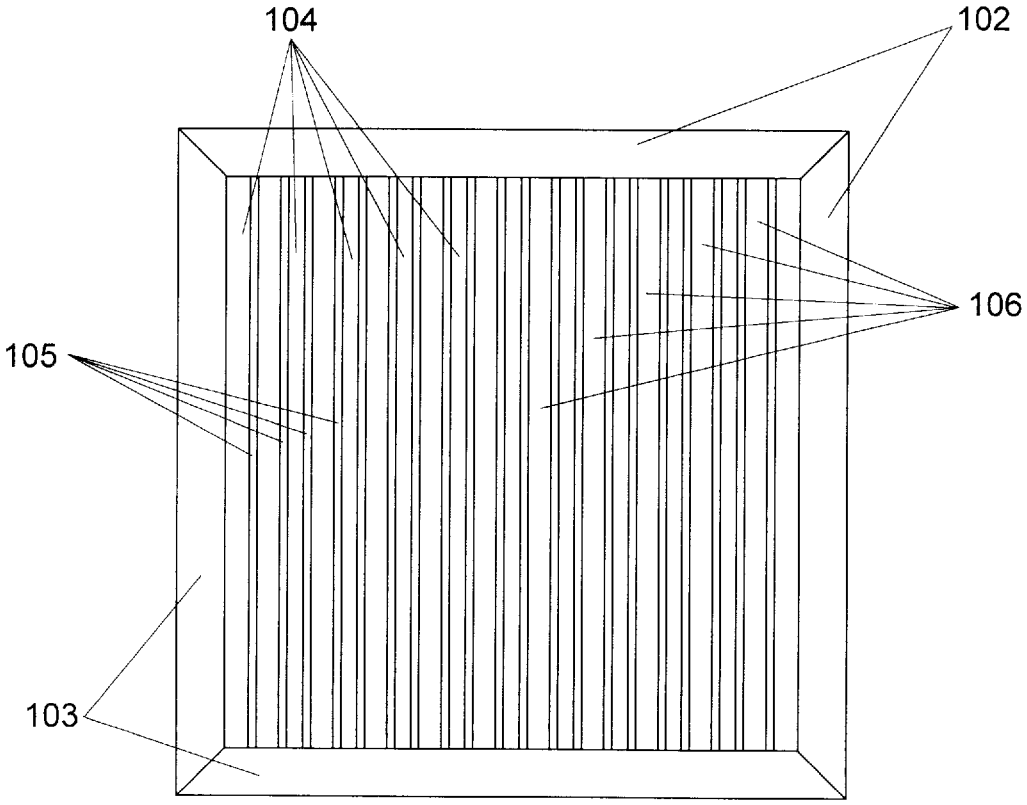

In an alternative embodiment of the present invention, the top of base frame 102 may be beveled as shown in FIGS. 6A and 6B. The beveled top surfaces 103 of base frame 102 slope downward inwardly toward rails 104. The sloped surfaces 103 may facilitate dispensing of golf balls over the edge of base frame 102, while still containing the base layer of balls within base frame 102. FIGS. 6A and 6B also show the top surfaces of substantially rectangular rails 104 with beveled edges 105, which may enhance the constraint of golf balls to roll along grooves 106.

In an alternative embodiment of the present invention, the center-to-center spacing of the rails may range from greater than the diameter of the golf balls to about 1.414 times the diameter of the golf balls. In such an embodiment, the tilt angle of the faces of hopper 150 may be modified to fit the resulting pyramidal stack. It should be noted that the angles of each of the faces need not be the same. The tilt angles between the faces of hopper 150 and a horizontal plane may range from about 30° to about 60°, depending on the spacing of the balls in the base layer of the pyramidal stack.

In an alternative embodiment of the present invention, the rails may have any size and/or transverse cross-section suitable for preventing passage of a golf ball between adjacent rails, for allowing golf balls to roll along grooves between adjacent rails, and for allowing clearance between balls in adjacent grooves. Suitable transverse cross-sectional shapes include but are not limited to: rectangle, square, circle, ellipse, oval, trapezoid, rhombus, quadrilateral, polygon, combinations thereof, and/or functional equivalents thereof. In an alternative embodiment of the present invention, the stacking apparatus may be adapted to create square pyramidal stacks of substantially spherical objects of any size by appropriately adjusting the dimensions and spacings of the base frame, rails, and hopper.

In an alternative embodiment of the present invention, the size of the base frame and the number of rails may be chosen to accommodate any base layer size. For a base layer of $N \times N$, the resulting N-layer pyramid holds $N \cdot (N+1) \cdot (2N+1)/6$ golf balls. In such a pyramidal stack, the topmost layer comprises a single ball, and each of the four faces of the pyramidal stack are triangular. For a base layer of $N \times M$ with $M \geqq N$, the resulting N layer pyramid holds $N \cdot (N+1) \cdot (3M-N+1)/6$ balls. In such a pyramidal stack, the topmost layer comprises a single row of $M-N+1$ balls, two opposing faces of the pyramidal stack are triangular, and the other two opposing faces of the pyramidal stack are trapezoidal. The shape and tilt angles of the faces of hopper 150 may be adjusted accordingly to accommodate the resulting stack.

In an alternative embodiment of the present invention, the stacking apparatus may be secured to the flat surface on which it rests, may be an integral structure of the flat surface on which it rests, or may be a separate, movable structure. In an alternative embodiment of the present invention, the lower edges of the rails may be positioned in the plane of the lower edge of the base frame, so that when placed on a flat surface both the base frame and rails are supported by the flat surface. In an alternative embodiment of the present invention, the lower edges of the base frame and/or rails may be notched, or alternatively a gap may be provided between the base frame and the surface on which it rests, to prevent accumulation of water between the rails and/or within the base frame when the stacking apparatus is used outdoors. In an alternative embodiment of the present invention, base frame 102 and rails 104 may be fabricated from any material with sufficient strength and rigidity to support a lo stack of golf balls. The rail material may be sufficiently deformable to dampen bouncing of golf balls as they are poured into the stacking apparatus. Such materials for the base and/or rails may include but are not limited to: wood, metal, plastics, concrete, stone, fiberglass, composites, combinations thereof, and/or functional equivalents thereof. In an alternative embodiment of the present invention, the hopper may be fabricated from any suitable material sufficiently rigid to contain golf balls as they are poured into the hopper, and sufficiently lightweight to allow ready placement over and removal from the base frame. Such materials include but are not limited to: wood, metal, plastics, fiberglass, composites, combinations thereof, and/or functional equivalents thereof.

The present invention has been set forth in the forms of its preferred and alternative embodiments. It is nevertheless intended that modifications to the disclosed golf ball stacking and dispensing apparatus and methods may be made without departing from inventive concepts disclosed and/or claimed herein.

What is claimed is:

1. An apparatus for stacking substantially spherical objects, comprising:

a substantially horizontal, substantially rectangular base frame having an upper surface and first, second, third, and fourth sides, the first side being opposite the third side, the second side being opposite the fourth side;

a plurality of rails, each having a first end, a second end, an upper surface, a transverse cross-section, and a centerline; and a hopper having a lower portion comprising a pyramidal shell having an open substantially rectangular base, four upwardly extending faces, and a truncated top, thereby providing a top opening, wherein:

the first end of each of the plurality of rails is secured to the first side of the base frame, the second end of each of the plurality of rails is secured to the third side of the base frame, each of the plurality of rails is substantially parallel to the second and fourth sides of the base frame, the plurality of rails is substantially uniformly spaced across the base frame, and the upper surface of each of the plurality of rails lies in a common substantially horizontal plane, thereby forming a plurality of substantially parallel grooves;

the base frame extends above the upper surface of each of the plurality of rails;

the spacing between the centerlines of each of the plurality of rails and an adjacent rail is greater than a diameter of the spherical objects, thereby allowing one of the spherical objects rolling along one of the plurality of grooves to roll past a second of the spherical objects rolling in an adjacent groove, and less than about 1.414 times the diameter of the spherical objects;

the transverse cross-section of each of the plurality of rails is sufficiently wide to prevent passage of the spherical objects between one of the plurality of rails and an adjacent rail;

the open base of the lower portion of the hopper may be placed on the base frame, thereby directing spherical objects poured through the top opening to form a rectangular base layer of spherical objects on the plurality of rails and to form a pyramidal stack of spherical objects on the base layer; and the hopper may be removed from the base frame while leaving the pyramidal stack of spherical objects intact.

2. A stacking apparatus as recited in claim 1, wherein the spherical objects are golf balls.

3. A stacking apparatus as recited in claim 2, wherein the rectangular base frame is substantially square, and the open rectangular base of the pyramidal shell is substantially square.

4. A stacking apparatus as recited in claim 3, wherein:

the first and third sides of the base frame are at least 15.1 inches apart, and the second and fourth sides of the base frame are at least 15.1 inches apart;

the plurality of rails are at least ten in number, and the plurality of grooves are at least nine in number;

the base layer of golf balls numbers at least nine balls by nine balls; and each of the faces of the pyramidal shell forms a tilt angle with a horizontal plane greater than about 30° and less than about 60°.

5. A stacking apparatus as recited in claim 4, wherein the base frame extends above the upper surfaces of the rails by a distance greater than or equal to about ½ inch.

6. A stacking apparatus as recited in claim 5, wherein the base frame is about three inches deep.

7. A stacking apparatus as recited in claim 6, wherein the rails have a substantially rectangular cross-section of about two inches high by about 1¼ inches wide.

8. A stacking apparatus as recited in claim 7, wherein the upper surfaces of the rails have beveled edges.

9. A stacking apparatus as recited in claim 5, wherein:

the first and third sides of the base frame are about 17.8 inches apart, and the second and fourth sides of the base frame are about 17.8 inches apart;

the plurality of rails are eleven in number, and the plurality of grooves are ten in number;

the base layer of golf balls numbers ten balls by ten balls; and each of the faces of the pyramidal shell forms a tilt angle with a horizontal plane greater than about 50° and less than about 53°.

10. A stacking apparatus as recited in claim 9, wherein the top opening of the hopper is provided with a downwardly tapered funnel-like structure for facilitating pouring of golf balls into the hopper.

11. A stacking apparatus as recited in claim 9, wherein the upper surface of the base frame is beveled, thereby forming an inwardly, downwardly sloping surface.

12. A method for creating a stack of substantially spherical objects using the apparatus of of claim 1, comprising the steps of:

a) placing the base of the lower portion of the hopper on the base frame;

b) pouring spherical objects through the top opening of the hopper until i) a full base layer of spherical objects is produced resting in the grooves between the rails, and ii) a full pyramidal stack of spherical objects is produced; and c) removing the hopper.

13. A method for creating a stack of golf balls using the apparatus of claim 2, comprising the steps of:

a) placing the base of the lower portion of the hopper on the base frame;

b) pouring golf balls through the top opening of the hopper until i) a full base layer of golf balls is produced resting in the grooves between the rails, and ii) a full pyramidal stack of golf balls is produced; and c) removing the hopper.

14. A method for creating a stack of golf balls using the apparatus of claim 9, comprising the steps of:

a) placing the base of the lower portion of the hopper on the base frame;

b) pouring golf balls through the top opening of the hopper until i) a full base layer of 100 golf balls is produced resting in the grooves between the rails, and ii) a full pyramidal stack of 385 golf balls is produced; and c) removing the hopper.

15. A method for creating a stack of golf balls using the apparatus of claim 10, comprising the steps of:

a) placing the base of the lower portion of the hopper on the base frame;

b) pouring golf balls into the funnel-like structure of the hopper until i) a full base layer of 100 golf balls is produced resting in the grooves between the rails, and ii) a full pyramidal stack of 385 golf balls is produced; and c) removing the hopper.

16. A method for dispensing substantially spherical objects from a pyramidal stack resting on the apparatus of claim 1, comprising the steps of:

a) placing, adjacent to a desired dispensing area, the apparatus with a pyramidal stack of spherical objects thereon;

b) orienting the apparatus so that a spherical object rolled along a groove and over the side of the base frame rolls into the dispensing area;

c) rolling spherical objects from the stack into the dispensing area; and d) rolling spherical objects from the base layer along a groove, over the side of the base frame, and into the dispensing area.

17. A method for dispensing golf balls from a pyramidal stack resting on the apparatus of claim 2, comprising the steps of:

a) placing, adjacent to a golf practice area, the apparatus with a pyramidal stack of golf balls thereon;

b) orienting the apparatus so that a golf ball rolled along a groove and over the side of the base frame rolls into the practice area;

c) rolling balls from the stack into the practice area; and d) rolling balls from the base layer along a groove, over the side of the base frame, and into the practice area.

18. A method for dispensing golf balls from a pyramidal stack resting on the apparatus of claim 9, comprising the steps of:

a) placing, adjacent to a golf practice area, the apparatus with a pyramidal stack of golf balls thereon;

b) orienting the apparatus so that a golf ball rolled along a groove and over the side of the base frame rolls into the practice area;

c) rolling balls from the stack into the practice area; and d) rolling balls from the base layer along a groove, over the side of the base frame, and into the practice area.

19. A method for dispensing golf balls from a pyramidal stack resting on the apparatus of claim 11, comprising the steps of:

a) placing, adjacent to a golf practice area, the apparatus with a pyramidal stack of golf balls thereon;

b) orienting the apparatus so that a golf ball rolled along a groove and over the side of the base frame rolls into the practice area;

c) rolling balls from the stack into the practice area; and d) rolling balls from the base layer along a groove, over the side of the base frame, and into the practice area.

* * * * *